US006194371B1

(12) United States Patent
Donovan et al.

(10) Patent No.: US 6,194,371 B1
(45) Date of Patent: Feb. 27, 2001

(54) STABLE ALKALINE EMULSION CLEANERS

(75) Inventors: Daniel J. Donovan, Mendota Heights, MN (US); Lynne A. Olson, Ellsworth, WI (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 09/070,805

(22) Filed: May 1, 1998

(51) Int. Cl.[7] ..... C11D 3/22

(52) U.S. Cl. ..... 510/396; 510/417; 510/418; 510/470; 510/505; 510/475

(58) Field of Search ..... 510/417, 418, 510/470, 505, 467, 488, 475, 324, 356, 396

(56) References Cited

U.S. PATENT DOCUMENTS

| | | | |
|---|---|---|---|
| 2,560,839 | 7/1951 | Ayo et al. | 252/109 |
| 3,234,183 | 2/1966 | Hay et al. | 260/47 |
| 3,350,319 | 10/1967 | Schonfeldt | 252/138 |
| 3,723,330 | 3/1973 | Sheflin | 252/153 |
| 3,723,341 | 3/1973 | Raymond et al. . | |
| 3,935,130 | 1/1976 | Hirano et al. | 252/542 |
| 3,970,595 | 7/1976 | Ginn et al. | 252/545 |
| 4,017,409 | 4/1977 | Demessemaekers et al. | 252/109 |
| 4,230,592 | 10/1980 | Miller et al. | 252/156 |
| 4,244,840 | 1/1981 | Straw | 252/540 |
| 4,320,026 | 3/1982 | Cristobal et al. | 252/139 |
| 4,414,128 | 11/1983 | Goffinet | 252/111 |
| 4,472,291 | 9/1984 | Rosano | 252/186.28 |
| 4,540,448 | 9/1985 | Gautier et al. | 148/6.15 R |
| 4,540,505 | 9/1985 | Frazier | 252/106 |
| 4,676,921 | 6/1987 | Vander Meer | 252/174.23 |
| 4,786,433 | 11/1988 | Marquardt et al. | 252/174.24 |
| 4,846,993 | 7/1989 | Lentsch et al. | 252/95 |
| 5,158,710 | 10/1992 | VanEenam | 252/539 |
| 5,174,912 | 12/1992 | Coffindaffer et al. | 252/8.8 |
| 5,174,927 | 12/1992 | Hosna | 252/543 |
| 5,330,674 | 7/1994 | Urfer et al. | 252/176.17 |
| 5,342,534 | 8/1994 | Skrobala et al. | 252/91 |
| 5,399,285 | 3/1995 | Kanluen | 252/174.23 |
| 5,409,633 | 4/1995 | Clements et al. | 252/186.42 |
| 5,474,713 | 12/1995 | Faber | 252/544 |
| 5,486,307 | 1/1996 | Misselyn et al. | 252/174.24 |
| 5,489,395 | 2/1996 | Behler et al. | 252/174.17 |
| 5,520,841 | 5/1996 | Block et al. | 252/174.23 |
| 5,525,256 | 6/1996 | Morris et al. | 252/108 |
| 5,531,915 | 7/1996 | Perkins | 510/294 |
| 5,565,145 | 10/1996 | Watson et al. | 510/350 |
| 5,575,864 | 11/1996 | Haley et al. | 134/42 |
| 5,576,284 | 11/1996 | Buskirk et al. | 510/384 |
| 5,597,407 | 1/1997 | Fischer et al. | 106/237 |
| 5,599,400 | 2/1997 | Mao et al. | 134/25.2 |
| 5,599,476 | 2/1997 | Behler et al. | 510/135 |
| 5,616,548 | 4/1997 | Thomas et al. | 510/242 |
| 5,616,781 | 4/1997 | Sajic et al. | 510/221 |
| 5,635,104 | 6/1997 | Kott et al. | 252/186.1 |
| 5,637,758 | 6/1997 | Sajic et al. | 560/147 |
| 5,656,584 | 8/1997 | Angell et al. | 510/441 |
| 5,686,400 | 11/1997 | Urfer et al. | 510/237 |
| 5,696,073 | 12/1997 | Jakubicki et al. | 510/426 |
| 5,705,466 | 1/1998 | Baillely et al. | 510/312 |
| 5,952,285 * | 9/1999 | Hawkins | 510/405 |
| 5,958,858 * | 9/1999 | Bettiol et al. | 510/351 |

FOREIGN PATENT DOCUMENTS

| | | |
|---|---|---|
| 2004895 | 6/1990 | (CA) . |
| 0 137 615 | 4/1985 | (EP) . |
| 0 137 616 | 4/1985 | (EP) . |
| 0 160 762 | 11/1985 | (EP) . |
| 0 469 847 A2 | 2/1992 | (EP) . |
| 0 487 262 A2 | 5/1992 | (EP) . |
| 2 033 421 | 5/1980 | (GB) . |
| 1603047 | 11/1981 | (GB) . |
| 2 144 763 | 3/1985 | (GB) . |
| 2 154 599 | 9/1985 | (GB) . |
| 3174496 | 7/1991 | (JP) . |
| 5098288 | 4/1993 | (JP) . |
| WO 90/13622 | 11/1990 | (WO) . |
| WO 91/00331 | 1/1991 | (WO) . |

* cited by examiner

*Primary Examiner*—William Krynski
*Assistant Examiner*—Dawn L. Garrett
(74) *Attorney, Agent, or Firm*—Merchant & Gould P.C.

(57) ABSTRACT

An alkaline emulsion detergent composition with improved phase stability, useful viscosity and excellent soil removal properties can comprise in an aqueous phase, an emulsion comprising a source of alkalinity, a nonionic surfactant blend, a water conditioning agent and an alkyl polyglucoside. The improved stable emulsions can be used in laundry applications or other soil removal processes. The compositions are typically prepared by forming an alkaline nonionic blend combining the blend with a water conditioning agent and the alkyl polyglucoside and shearing the resulting aqueous mixture to form an emulsion characterized by a preferred particle size and viscosity.

37 Claims, 2 Drawing Sheets

Stability Effects of APG 625-5

Stability Effects of APG 625

STABLE ALKALINE EMULSION CLEANERS

FIELD OF THE INVENTION

The invention relates to a viscosity, phase and particle size stable aqueous alkaline emulsion cleaning concentrate or composition characterized by a reduced water concentration (a high concentration of active materials such as alkalinity and surfactants) and to methods of their use and preparation. In industrial or institutional applications, the materials are phase stable, are easily pumpable (have useful viscosity) from automatic or programmable dispensers to a use locus where they are easily mixed with water in a use locus to form an aqueous cleaner. The emulsions are easily made and are effective in soil removal in laundry, ware washing, clean-in-place and dairy applications. The compositions provide improved or enhanced soil removal properties because of high alkaline and surfactant contact.

BACKGROUND OF THE INVENTION

Cleaning compositions have been formulated in solid block, particulate and liquid form. Solid forms provide high concentrations of actives, but must be dissolved in water to form a cleaning liquid. Substantial attention in recent years has been directed to liquid detergent concentrates and in particular, liquid detergents in emulsion form. Such detergent concentrates typically are not as highly active as solids and are often greater than 50% water. Detergent emulsion concentrates have been employed as all purpose cleaners, warewashing detergents and in formulations for cleaning hard surfaces by diluting the concentrate with water. Many such concentrates are exemplified by those described in U.S. Pat. Nos. 2,560,839, 3,234,183 and 3,350,319. These formulations comprise substantial proportions of a phosphate sequestrant and other components in an aqueous base. In U.S. Pat. Nos. 4,017,409 and 4,244,840 liquid detergents having reduced phosphate content have been disclosed. Some detergents have been made which are phosphate free such as those described in U.S. Pat. Nos. 3,935,130, 4,786,433 and 4,846,993. Attention has been given to emulsion and microemulsion compositions for use in a variety of applications including softening, hard surface cleaning, etc. Among such disclosures are European Patent Specification Nos. 137615, 137616, and 160762 and U.S. Pat. Nos. 4,561,488 and 4,786,433. Additional formulas of emulsion and microemulsion compositions having varying formulations include U.S. Pat. Nos. 3,723,330, 4,472,291 and 4,540,448. The typical emulsion liquid is less than 60% actives, less than 10% surfactant less than 30–40% alkalinity. Additional formulations of liquid detergent compositions in emulsion form which include hydrocarbons, magnesium salts, terpenes and other ingredients for enhancing cleaning properties include British Patent Specification Nos. 1603047, 2033421, 2144763, European Specification No. 80749 and U.S. Pat. Nos. 4,017,409, 4,414,128 and 4,540,505. Many of these emulsions are not sufficiently phase stable for storage and use in a variety of applications, have reduced actives concentration (comprise greater than 50% water) or display reduced properties compared to other useful forms of detergent or are difficult to manufacture, pump or store.

Miller et al., U.S. Pat. No. 4,230,592; Morris et al., U.S. Pat. No. 5,525,256; and Trabitzsch, Canadian Pat. No. 2,004,895 teach aqueous detergents with relatively low active concentrations. These references all teach relatively low caustic content and relatively low sequestrant and surfactant contents. These materials appear to be fairly simple solutions, without a substantial dispersed portion, of the material in an aqueous medium. The materials can be pumped and used as is.

Substantial attention has been directed to concentrate materials having substantially increased active content that can be manufactured as stable liquids. A need has existed to push the active concentrate of detergent components in the emulsion to 60 to 65% in order to provide the efficacy and performance of solids. These liquids must have a stable viscosity and a handleable viscosity such that the liquid can be reliably pumped from a source of the material to a use locus such as a laundry machine. We have found that, if the materials of the prior art are simply increased in concentration without the introduction of new technology, the resulting materials do not form simple solutions, do not form phase stable emulsions, or often produce materials that have high viscosities and are difficult to pump and use.

While the prior art discloses a variety of liquid emulsion detergent compositions that can be used in a variety of forms, the prior art does not provide a stable aqueous emulsion with a high active cleaning composition that is easy to manufacture, has acceptable cleaning properties in laundry, warewashing and other uses, is pumpable in conventional liquid detergent dispensers and are compatible with typical industrial or institutional cleaning equipment. We have filled a substantial need in improving emulsion stability using emulsion particle size, emulsion viscosity and cleaning properties by improving emulsion formulations and methods of manufacture. A substantially improved emulsion detergent composition, methods of its use and methods of preparation have been discovered and are disclosed below.

SUMMARY OF THE INVENTION

We have found an improved aqueous highly active detergent emulsion composition. The emulsion composition comprises an emulsion in an aqueous base comprising a source of alkalinity, a nonionic surfactant, a water conditioning or sequestering agent, and an alkyl polyglucoside surfactant. The resulting stable emulsions are characterized by a low water content, high actives concentration (greater than 60 wt % based on the concentrate composition), and a particle size of the emulsified phase dispersed in the aqueous phase, having a particle size less than about 10 microns, preferably about 0.01 to 5 microns. Phase stable means that the emulsion, when centrifuged at 1100–2500 rpm in a 50 ml graduated tube in a International Equipment Centrifuge model CL for 5 minutes, does not phase separate. The stable emulsions are also characterized by a surprisingly low viscosity that ranges from about 500 to 5000 centipoise (cP) and from about 200 to 2000 cP measured at 23° C. with a RTV Brookfield viscometer using a #3 spindle at 20 and 50 rpm, respectively. This improved emulsion detergent can be used for a variety of applications but preferably is used in laundry applications. We have achieved cleaner formulations that comprise 30 wt % or greater of both the alkaline source and the surfactant load. We have found that the balance of hydrophobe and hydrophilic function of an alkyl polyglycoside achieves a interfacial tension that stabilizes the emulsion at the aqueous droplet interface.

In laundry applications, soiled articles are contacted with an aqueous liquid cleaning liquor comprising a major proportion of water and about 250 to 5000 ppm of the emulsion detergent. The clothes are contacted with the washing liquor at an elevated temperature of from about 25° C. to about 80° C. for a period of time to remove soil. The soil and used liquor are then rinsed from the clothing in a rinse cycle. The improved liquid emulsion detergents are made by a process that comprises the steps of combining the nonionic surfactant or surfactant blend with a source of alkalinity to provide an alkaline surfactant blend; combining the alkaline surfactant blend with the water conditioning or sequestering agent the alkyl polyglucoside to form a blended detergent and exposing the blended detergent to other ingredients with mixing equipment for a sufficient period of time to create and emulsion characterized by the particle size of the disperse phase and a viscosity that is set forth above. The resulting detergent material can be pumped into containers. When used in laundry applications, the stable laundry detergent can be easily pumped and metered into conventional cleaning equipment. In other applications, a suitable surfactant can be selected for warewashing, or hard surface cleaning.

For the purpose of this patent application, the term "emulsion" connotes a continuous aqueous phase and a dispersed substantially insoluble liquid organic phase in droplet form forming an emulsion. The dispersed phase is typically made from materials that are used at concentrations that or in amounts that are above the amount that can be solubilized in the aqueous phase. The insoluble or non-water soluble portion, typically a liquid nonionic surfactant, forms dispersed particles having a particle size less than about 10, less than about 5 microns, preferably between about 0.1 and 5 microns. The emulsions can contain sold materials dispersed in the organic or the aqueous phase. These materials are often stabilized at the droplet aqueous interface. The aqueous phase can contain one two or more aqueous soluble components and the dispersed phase can contain one, two or more relatively insoluble components to form a stable emulsion. Phase stable connotes that under typical manufacturing, storage and use conditions, the dispersed phase does not substantially lose its finely divided form and separate from the aqueous phase to a degree that the material becomes not useful in a laundry or other cleaning purpose. Some small amount of separation can be tolerated as long as the emulsion retains the bulk of the insoluble phase (predominantly organic materials) in small emulsified form and provides cleaning activity. Stable dispersed particle size connotes the dispersed phase particles do not combine to form particles much larger than about 10 microns or much smaller than about 0.01 micron. The stable particle size is important for maintaining a stable dispersed emulsion phase. A quick test for phase stability is the centrifuge test described below.

The aqueous materials of the invention typically involve the emulsification of a relatively insoluble, typically organic phase and an aqueous phase. The organic phase can contain one or more components such as surfactants, water conditioning agents, brighteners, etc. while the aqueous phase can contain, in an aqueous medium, aqueous soluble components such as sodium hydroxide, dyes and other components. The materials are typically made by dispersing the relatively "oily" organic insoluble phase in the aqueous phase stabilized by an emulsion stabilizer composition with the application of shear. In this invention the emulsion stabilizer typically comprises the alkylpolyglycoside surfactant at an amount that can promote a stable emulsion. We have found that the preferred emulsion stabilizers are alkylpolyglycoside (APG) surfactants that are sufficiently soluble in sodium hydroxide and promote small particle size formation in the typical organic phase used in the emulsions of the invention. We have found that simple mixtures of aqueous sodium hydroxide and nonionic surfactant such as a nonylphenol ethoxylate without an emulsion stabilizer will rapidly separate into two separate phases. Such surfactants have low solubility in sodium hydroxide while sodium hydroxide is insoluble in this organic. Certain alkylpolyglycosides having low sodium hydroxide solubility appear to be as useful as more alkali soluble alkylpolyglycosides. Both types can aid in the formation of small emulsion particles. The useful procedure for forming the dispersions of the invention involves adding aqueous caustic, typically 50 wt % aqueous caustic to a large metal vessel containing agitation apparatus. The organic phase such as a nonylphenol ethoxylate with 9.5 moles of EO is added to the vessel with a caustic. The APG can be added at this time and the contents of the vessel can be agitated strongly to begin emulsion formation. The alkylpolyglycoside can be added at this point or at any time later after the addition of all other ingredients but before initiation of shear. One preferred order of addition of materials follows the following sequence: water conditioning agent, polymeric materials, additives, additional caustic, additional surfactant, alkylpolyglycoside emulsion stabilizer. The combined materials in a mixture form is then emulsified at high shear until the particle size is reduced to less than 10 microns, preferably less than 5 microns. At that particle size, the mixture tends to be stable and non-separating. Care should be taken during the addition of the organic materials to avoid excessive heating during the addition of the materials. Exceeding 180° F. can cause problems, particularly with the phosphonate water conditioning agents.

Although the main emphasis is on laundry detergents, this emulsion concept could be applied elsewhere as well. This would include warewashing, clean in place cleaners and sanitizers, food and dairy formulations. In general, this emulsion concept could be used in any formulation where relatively insoluble nonionic surfactants are mixed with caustic solutions to form an emulsion with properties balanced for the selected end use. The low foaming surfactants can comprise nonionics such as such as the nonylphenol 9.5 mole ethoxylate, linear alcohol ethoxylates, ethylene oxide/propylene oxide copolymers, ethylene oxide/propylene oxide/ethylene oxide copolymers, propylene oxide/ethylene oxide/propylene oxide copolymers (Pluronics (BASF), Pluronics R (BASF), and Ecolab's surfactants (D-097, D500 and LD-097)) and the capped alcohol ethoxylates or nonylphenol ethoxylates such as Ecolab's LF41, Ecolab's LF428, the Plurafacs (BASF) and the Polytergents (BASF).

DETAILED DISCUSSION OF THE INVENTION

Figure 1:
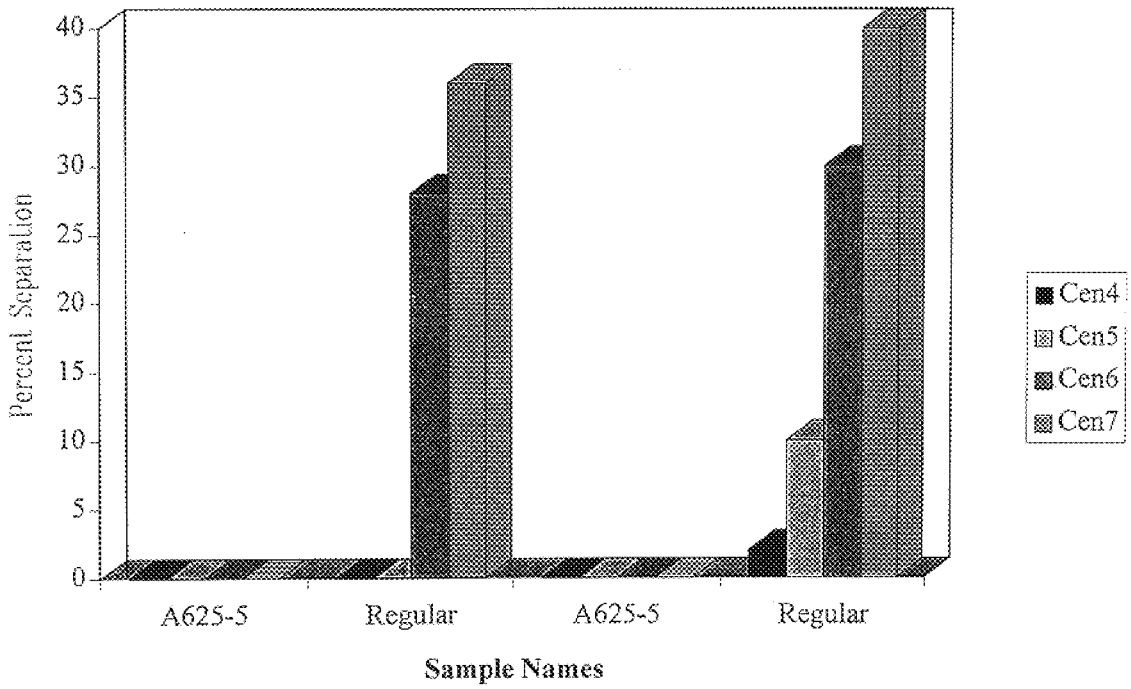
FIG. 1 is a 3D column graph which demonstrates the stabilizing effects of APG 625 on particular formulations.

Traditionally, emulsions have concerned systems of two isotropic, substantially Newtonian liquids, one being dispersed in the other in the form of small droplets. The system is stabilized by absorbed amphiphiles which modify interfacial properties. However, we have found that a large number of emulsions act in more than two phases. A discussion of emulsions and emulsion stability will begin with the traditional two-phase system. An emulsion forms when two immiscible liquids, usually water and oil, for example, are agitated so that one liquid forms droplets dispersed within the other liquid. Emulsions are stabilized by a compound adsorbed at the interface. This compound is termed an "emulsifier." These are molecules which possess both polar and nonpolar regions and which serve to bridge the gap between the two immiscible liquids. For example, in an oil-and-water emulsion, the polar portion of an emulsifier is soluble in the water phase, while the nonpolar region is soluble in the oil phase. In general, formation of an emulsion or emulsification involves breaking large droplets into smaller ones due to shear forces.

In order to discuss the stability of emulsions, it is necessary to first discuss how an emulsion fails. The initial step in emulsion failure is known as flocculation, in which individual droplets become attached to each other but are still separated by a thin film of the continuous phase. The next step is coalesence, in which the thin liquid film between the individual droplets destabilizes, allowing large droplets to form. As coalescence continues, the emulsion separates into an oil layer and an aqueous layer. In general, emulsions are stabilized by slowing the destabilization or flocculation process. This can be done either by reducing the droplet mobility, by increasing viscosity or by the insertion of an energy barrier between droplets. In the invention, the size of droplets or particles of the dispersed phase are less than 10 microns, preferably less than 5 microns in diameter. Most preferred emulsion form uses a droplet or particle size which is between 0.01 $\mu$m and 4 $\mu$m.

Alkalinity Source

A source of alkalinity is needed to control the pH of the use detergent solution. The alkalinity source is selected from the group consisting of alkali metal hydroxide, such a sodium hydroxide, potassium hydroxide or mixtures thereof; an alkali metal silicate such as sodium metasilicate may also be used. The preferred source, which is the most cost-effective, is commercially available sodium hydroxide which can be obtained in aqueous solutions in a concentration of about 50 wt-% and in a variety of solid forms in varying particle sizes. The sodium hydroxide can be employed in the invention in either liquid or solid form or a mixture of both. Other sources of alkalinity are useful but not limited to the following: alkali metal carbonates, alkali metal bicarbonates, alkali metal sesquicarbonates, alkali metal borates and alkali metal silicate. The carbonate and borate forms are typically used in place of the alkali metal hydroxide when a lower pH is desired.

Nonionic Surfactant

Conventional, nonionic detersive surfactants that can be used with the invention include the polyethylene, polypropylene, and polybutylene oxide condensates of alkyl phenols. These materials are generally soluble in aqueous media at the amount of less than 5 wt %. In general, the polyethylene oxide condensates are preferred. These compounds include the condensation products of alkyl phenols having an alkyl group containing from about 6 to about 12 carbon atoms in either a straight chain or branched chain configuration with the alkylene oxide. In a preferred embodiment, the ethylene oxide is present in an amount equal to from about 5 to about 25 moles of ethylene oxide per mole of alkyl phenol. The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 2 to about 10 moles of ethylene oxide per mole of alcohol. The condensation products of ethylene oxide with a hydrophobic base formed by the condensation of propylene oxide with propylene glycol. The hydrophobic portion of these compounds preferably has a molecular weight of from about 1500 to about 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. The condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000.

Alkyl Polyglucoside Emulsion Stabilizing Surfactant

We have found that the emulsions of the invention are stabilized using an alkylpolyglycoside surfactant. Such surfactants have a strongly hydrophobic alkyl group with a strongly hydrophilic glycoside group that can have its hydrophilicity modified by the presence of ethylene oxide groups. We have found these materials are effective emulsion stabilizers when the material is soluble in the aqueous phase and can promote small particle size emulsions. The alkyl polyglucoside (Glucopon 625) that is used in most of the examples contained a hydrophobic group with an alkyl straight chain of $C_{12}$ to $C_{16}$. The hydrophilic group was a glucose moiety with an average degree of polymerization (DP) of 1.4. This material does not have very good solubility in sodium hydroxide solutions. There are other commercially available alkyl polyglucosides with different alkyl groups and DP's. In some of the examples Glucopon 225 CS was used as the emulsion stabilizer. It contained an alkyl hydrophobic group of $C_8$ to $C_{10}$ with a glucose as the hydrophilic group and a DP of 1.7. This material is very soluble in sodium hydroxide. The general class of alkyl polyglucosides produces low interfacial tension between mineral oil and water. Low interfacial tension is probably responsible for the success of these surfactants in stabilizing the emulsion. The system that is being used is different than the typical emulsion. The oil phase is the surfactant (nonylphenol ethoxylate) while the aqueous phase is the sodium hydroxide solution along with other materials. There is probably a third phase involved that might form an interface between the surfactant phase and the sodium hydroxide solution. The alkyl polyglucoside can be pictured at the surfactant/sodium hydroxide interface.

A simple mixture of aqueous sodium hydroxide (20 to 50% active) and surfactant (nonylphenol ethoxylate 9.5) without alkyl polyglucoside will form two separate phases. The surfactant (nonylphenol ethoxylate) has essentially no solubility in the sodium hydroxide solution and the sodium hydroxide has essentially no solubility in the surfactant phase (NPE 9.5). The surfactant phase is essentially anhydrous and will contain only surfactant. With the addition of alkyl polyglucoside the surfactant phase can be emulsified into the sodium hydroxide phase. Alkyl polyglucoside alone appear to stabilize the emulsion.

The commercial literature indicates that Glucopon 225 is very soluble in solution of sodium hydroxide. Solubility of Glucopon 225 will decrease from 60 to 28% as the activity of the sodium hydroxide is increased from 10 to 40%, respectively. Glucopon 625 is much less soluble and it will decrease from 20% to less than 1% in 10 to 40% sodium hydroxide solutions, respectively. The alkyl polyglucosides are soluble in the surfactant phase. These general observations indicated that the alkyl polyglucoside is mostly in the surfactant phase and at the interface of sodium hydroxide solution and the surfactant. There is probably a small amount of alkyl polyglucoside dissolved in the sodium hydroxide solution. Therefore, the alkyl polyglucosides stabilize the emulsion by reducing the interfacial tension between the sodium hydroxide solution phase and surfactant phase. With this general concept it can be envisioned that other surfactants can be used and would stabilize the emulsion in these systems if they reduced the interfacial tension of sodium hydroxide solution with a surfactant.

The examples indicate the alkyl polyglucoside are the materials that decrease the particle and stabilize the emulsion. Any surfactant whose hydrophilic group is soluble in sodium hydroxide and whose hydrophobic group is soluble in the surfactant phase, which would produce a low interfacial tension, should produce a stable emulsion. However, preferred alkyl polyglucosides have the formula:

$$RO(C_nH_{2n}O)_y(HEX)_x$$

wherein HEX is derived from a hexose including glucose; R is a hydrophobic typically lipophilic group selected from groups consisting of alkyl, alkylphenyl, hydroxyalkylphenyl and mixtures thereof in which said alkyl groups contain from about 8 to about 24 carbon atoms; n is 2 or 3; R is about 0 to 10 and x is about 1.5 to 8. More preferred are alkyl polyglucosides wherein the alkyl group has about 6 to about 24 carbon atoms and wherein y is 0 and x is about 1.5 to 4.

Water Conditioners

The water conditioning, hardness ion chelating or calcium, magnesium, manganese or iron sequestering agents suitable for use in the invention include organic phosphonates, NTA and alkali metal salts thereof, EDTA and alkali metal salts thereof, anionic polyelectrolytes such as polyacrylates and acrylic acid copolymers, itaconic acid copolymers such as an acrylic/itaconic acid copolymer, maleates, sulfonates and their copolymers, alkali metal gluconates. Also suitable chelating agents are organic phosphonates such as 1-hydroxyethylidene-1,1-diphosphonic acid, amino tri(methylene phosphonic acid), hexamethylene diamine tetra(methylene phosphonic acid), diethylene triamine penta(methylene phosphonic acid), and 2-phosphonobutane-1,2,4-tricarboxylic acid and other commercially available organic phosphonates water conditioning agents. Most conventional agents appear to work since they are compatible in either the continuous phase or the droplet phase. The examples that were provided contain a mixture of poly(acrylic acid)and butane(tricarboxylic acid) phosphonic acid as the builder. The latter material contains phosphorus and the whole formulation is considered to be phosphorus formula. Phosphorous containing and phosphorus free formulations have been developed with the alkyl polyglucosides having acceptable cleaning properties. These have properties similar to the examples except that they do not contain phosphorus.

Minor Ingredients

Detergents typically contain a number of conventional, important but minor ingredients. These can include optical brighteners, soil antiredeposition agents, antifoam agents, low foaming surfactants, defoaming surfactants, pigments and dyes, which are used in these formulas. The compositions can also include chlorine and oxygen bleaches, which are not currently used in these formulas. Such materials can be formulated with the other ingredients or added during cleaning operations.

Experimental Results

A series of tests were conducted to study various formulations and their resulting stability and viscosity. Although each series of formulations will be discussed individually, a brief overview is given now.

Tables 1 a,b,c involve formulations in which the builder system is modified.

Tables 2 a,b,c involve formulations in which alkyl polyglucosides are added to the formulations.

Table 3 is a comparison between the claimed invention and materials disclosed in GB Patent 2001797.

Tables 4 a,b,c involve formulations in which alkyl polyglucosides are used in caustic emulsions.

Table 5 shows soluble emulsion formulae.

The following preparations of emulsion materials and data showing stability of particle size and viscosity further exemplify the invention and disclose a best mode.

The centrifuge used for these tests is an International Equipment Centrifuge Model CL. Centrifuge speeds are listed below.

| | Setting 4 | Setting 5 | Setting 6 | Setting 7 |
|---|---|---|---|---|
| Low range (rpm) | 1398 | 1659 | 2033 | 2375 |
| High Range (rpm) | 1500 | 1897 | 2151 | 2502 |
| Average (rpm) | 1453 | 1778 | 2092 | 2438 |

TABLE 1a gives the specific formulations for the first series of tests, in which the builder system comprises either poly(acrylic) acid (PAA)(colloids 106/Acusol 944) or neutralized poly(acrylate) powder (Acc 445). Both formulations are stable and useful. The formulations contain 26 to 30 wt % NaOH and 30 wt % nonionic.

| Sample Names | | NaOH 50% | NPE 9.5 | APG 625 | Bayhibit | PAA | Acc 44S powder | CBS-X | Pigment Blue | $H_2O$ |
|---|---|---|---|---|---|---|---|---|---|---|
| HA4:1:N30 | A625-5 | 54.9 | 30 | 5 | 2 | 8 | | 0.05 | 0.004 | 0.05 |
| HA4:1:N30 | | 59.9 | 30 | | 2 | 8 | | 0.05 | 0.004 | 0.05 |
| HA:4:2.6:2:N30 | A625-5 | 56.3 | 30 | 5 | 2 | 4 | 2.6 | 0.05 | 0.004 | 0.05 |
| SA6:2.6:2:N30 | A625-5 | 54.3 | 30 | 5 | 2 | 6 | 2.6 | 0.05 | 0.004 | 0.05 |
| SA6:2.6:2.5:N30 | A625-5 | 53.8 | 30 | 5 | 2.5 | 6 | 2.6 | 0.05 | 0.004 | 0.05 |
| UA4:5.2:3:N30 | A625-5 | 52.7 | 30 | 5 | 3 | 4 | 5.2 | 0.05 | 0.004 | 0.05 |
| SA4:1N30 | A625-5 | 52.5 | 30 | 5 | 2.5 | 10 | | | | |

| Formula Symbol | Raw Material | Description |
|---|---|---|
| NaOH 50% | Sodium Hydroxide | Aqueous 50% Caustic Soda |
| NPE 9.5 | Nonylphenol Ethoxylate 9.5 | 100% Nonionic Surfactant |
| APG 625 | Glucopon 625 | Alkyl Polyglucoside ($C_{12-16}$) DP 1.60 |
| Bayhibit | Bayhibit PBS-AM | Aqueous 50% Phosphono Butane Tricarboxylic Acid |
| PAA | Polyacrylic Acid(Colloids 106 or Accusol 944) | Aqueous 50% Partially Neutralized Polyacrylic Acid |
| Acc 44S (powder) | Accusol 445 ND | 100% Sodium Polyacrylate, Neutralized, Dry |
| CBS-X | Tinopal CBS-X | Optical Brightener |
| Pigment Blue | Pigment Blue 15 | Soft Water |
| H2O | Water | |

TABLE 1b gives another picture of the formulations tested, by comparing the poly(acrylic) acid (Colloids 106 or Accusol 944) and tricarboxylic acid (Bayhibit PBS-AM) levels and ratios. The formulation can comprise a variety of materials in broad ranges depending on end use.

| Compound Name | | PAA and Bayhibit Level | PAA to Bayhibit Ratio | Surfactant Level | APG 625 |
|---|---|---|---|---|---|
| HA4:1:N30 | A625-5 | High | 4:1 | 30% | 5% |
| HA4:1:N30 | | High | 4:1 | 30% | |
| HA4:2.6:2:N30 | A625-5 | High | 4:2.6(powder):2 | 30% | 5% |
| SA6:2.6:2:N30 | A625-5 | Super | 6:2.6(powder):2 | 30% | 5% |
| SA6:2.6:2.5:N30 | A625-5 | Super | 6:2.6(powder):2.5 | 30% | 5% |
| UA4:5.2:3:N30 | A625-5 | Ultra | 4:5.2(powder):3 | 30% | 5% |
| SA4:1 N30 | A625 | Super | 4:1 | 30% | 5% |

TABLE 1c gives the viscosity and centrifuge results for the aforementioned formulations.

| ID | Compound Name | | Viscosity 20 rpm | Viscosity 50 rpm | Ambient Stability | Particle Size (μm) | % separation @ Centrifuge Speeds Cen4 | Cen5 | Cen6 | Cen7 |
|---|---|---|---|---|---|---|---|---|---|---|
| FI | HA4:1:N30 | A625-5 | 1890 | 1602 | ok | <0.625 | 0% | 0% | 2% | 4% |
| FJ | HA4:1:N30 | | 3760 | >2,000 | ok | 1.25–13.125 | 0% | 0% | 2% | 6% |
| FM | HA4:2.6:2:N30 | A625-5 | 1670 | 1408 | ok | <0.625 | 7% | 8% | 8% | 8% |
| FN | SA6:2.6:2:N30 | A625-5 | 1150 | 1014 | ok | <0.625 | 8% | 8% | 8% | 8% |
| FO | SA6:2.6:2.5:N30 | A625-5 | 1755 | 1482 | ok | <0.625 | 4% | 8% | 8% | 8% |
| FP | UA4:5.2:3:N30 | A625-5 | 1980 | 1698 | ok | <0.625 | 12% | 14% | 14% | 14% |
| CB | SA4:1 N30 | A625-5 | >5000 | >2000 | ok | <1–2 | 0% | 0% | 0% | |

We have found that the concentration of the builder system can be increased without increasing the overall viscosity of the formulations to such a high viscosity such that they are not pumpable or otherwise not useful in a use locus. Some of the poly(acrylic acid) can be replaced with neutralized poly(acrylate) powder. Sample FI is a typical formulation with typical viscosities made with liquids. Sample FM is also a typical formulation, but is made with 2.6% powdered poly(acrylate). FM's viscoaity is lower than FI's viscoaity. In samples FN, FO and FP the builder system is progressively increased. FP's viscosity is similar to FI's viscosity, but FP has a higher concentration of builder.

TABLE 2a gives the specific formulations for a second series of tests, in which polyalkylglucosides were added to the formulation. These formulations contain 27 to 36 wt % NaOH and 30 to 30 wt % nonionic.

| Sample Names | | NaOH 50% | NPE 9.5 | APG 625 | Bayhibit | PAA | DASC-3 |
|---|---|---|---|---|---|---|---|
| M4:1:N20 | A625-5 | 67.4 | 20 | 5 | 1.5 | 6 | 0.15 |
| M4:1:N20 | | 72.4 | 20 | | 1.5 | 6 | 0.15 |
| H4:1:N30 | A625-5 | 54.8 | 30 | 5 | 2 | 8 | 0.225 |
| H4:1:N30 | | 59.8 | 30 | | 2 | 8 | 0.225 |

| Formula Symbol | Raw Material | Description |
|---|---|---|
| NaOH 50% | Sodium Hydroxide | Aqueous 50% Caustic Soda |
| NPE 9.5 | Nonylphenol Ethoxylate 9.5 | 100% Non-ionic Surfactant |
| APG 625 | Glucopon 625 | Alkyl Polyglucoside ($C_{12-16}$) DP 1.60 |
| Bayhibit | Bayhibit PBS-AM | Aqueous 50% Phosphono Butane Tricarboxylic Acid |
| PAA | Polyacrylic Acid (Colloids 106 or Accusol 944) | Aqueous 50% Partially Neutralized Polyacrylic Acid |
| DASC-3 | Blankophor DML | Optical Brightener |

TABLE 2b gives another picture of the formulations tested, by comparing the poly(acrylic) acid (Colloids 106 or Accusol 944) and 2-phosphonobutanetricarboxylic acid (Bayhibit PBS-AM) levels and ratios with and without alkylpolyglycoside.

| Compound Name | | PAA 106 to Bayhibit Level | PAA 106 to Bayhibit Ratio | Surfactant Level | APG 625 |
|---|---|---|---|---|---|
| M4:1:N20 | A625-5 | Medium | 6:1.5 | 20% | 5% |
| M4:1:N20 | | Medium | 6:1.5 | 20% | |
| H4:1:N30 | A625-5 | High | 8:2 | 30% | 5% |
| H4:1:N30 | | High | 8:2 | 30% | |

TABLE 2c gives the viscosity and centrifuge results for the aforementioned formulations.

| ID | Compound Name | | Viscosity 20 rpm | Viscosity 50 rpm | Ambient Stability | Particle Size (μm) | % separation @ Centrifuge Speeds Cen4 | Cen5 | Cen6 | Cen7 |
|---|---|---|---|---|---|---|---|---|---|---|
| VI | M4:1:N20 | A625-5 | 1390 | 1066 | ok | 0.625–3.125 | 0% | 0% | 0% | 0% |
| VII | M4:1:N20 | | 1560 | 1012 | ok | 2.5–43.75 | 0% | 0% | 28% | 36% |
| XI | H4:1:N30 | A625-5 | 1775 | 1398 | ok | 0.625 | 0% | 0% | 0% | 0% |
| XII | H4:1:N30 | | 2770 | 1688 | ok | 1.25–39.375 | 2% | 10% | 30% | 40% |

We found that the addition of alkyl polyglucoside to the formulations resulted in better stability (see VI and XI), particle size reduction and a lower viscosity in formulations that contain medium and high levels of surfactants and builders.

With lower amounts of poly(acylic acid), Bayhibit PBS-AM and NPE 9.5 (examples VI and VII) the viscosities are similar for formulation with and without alkylpoly (glucoside). When the poly(acrylic acid), Bayhibit PBS-AM and NPE 9.5 are increased, the formulation with alkyl polyglucoside is significantly lower in viscosity.

Stability with the centrifuge test is better for the formulations (VI and XI) with aklyl polyglucoside than the formulations without alkyl polyglucoside (VII and XII). This is shown graphically in FIG. 1. Particle size (diameter in microns) decreased with the addition of alkyl polyglucoside to the formulations. Particle size reduction appeared to correlate with stability with the centrifuge test.

TABLE 3 gives the formulations used in comparing the disclosure of GB Patent 2001897 to the claimed invention.

| Raw Material | 1 | 2 | 3 | 4 | 5 | Sample | Invention |
|---|---|---|---|---|---|---|---|
| Alkyl Glucoside | 6.00 | 6.00 | 8.00 | 6.00 | 7.00 | 7.00 | 20.0 |
| $C_{12-15}EO7$ | 1.00 | 1.00 | | 1.00 | 1.00 | 1.00 | 2.0 |
| NaOH | 10.00 | 12.50 | 15.00 | 6.00 | 11.00 | 11.00 | 20.0 |
| $Na_2SiO_3$ silicate ($Na_2O:SiO_2$ = 1:3.3) | 2.00 | 2.0 | 2.0 | 0.7 | 2.5 | 2.7 | 12.0 |
| NTA | 8.00 | 8.0 | 8.0 | 6.0 | 5.0 | 5.0 | 9.0 |
| HEDP | 2.00 | | 1.0 | 1.0 | 3.5 | | 3.0 |
| Dequest 2010 | | | | | | 3.0 | |
| EDTMP | | 1.0 | | | | | |
| DTPMP | | | 1.0 | | 1.0 | | |
| Bayhibit PBS-AM | | | | | | 1.0 | |
| OB | 0.10 | 0.1 | 0.1 | 0.1 | 0.1 | | |
| Sodium cumesulfonate | 29.10 | | | 4.0 | | | |
| isopropanol | | | | 5.0 | | | |
| Water | 70.90 | 69.4 | 64.9 | 70.2 | 68.9 | 69.3 | 34.0 |
| Total | 129.10 | 100.0 | 100.0 | 100.0 | 100.0 | 100.0 | 100.0 |
| Percent Active | 29.10 | 30.6 | 35.1 | 20.8 | 31.1 | 30.7 | 66.0 |

One formulation was made similar to the formulation listed in GB patent 2001897 and is listed as sample. This composition was a homogeneous clear solution (no emulsion) at room temperature. These formulations used the alkyl polyglucoside to promote solubility or to couple-in the alcohol ethoxylate into the solution. The reference formulation used Glucopon 225 ($C_8$ to $C_{10}$) in the formulation. This material is soluble in this sodium hydroxide solution and coupled or solubilized the alcohol ethoxylate to produce a homogeneous solution.

The solution appeared clear when a sample was examined under the microscope. There is no evidence of droplets in the solution when it is observed under the microscope at 400× with normal light transmission. It is an isotropic solution because it appeared dark through crossed polars under the microscope. No structure or any light appeared under the microscope using the crossed polars.

The formulations given as 1–5 represent typical examples from GB 2001897, Sample is a representative formulation of the general disclosure in the patent reference while the formulation given as "claims" represents a formula of the invention. The formulations of the invention have twice the active ingredients, half water and are true emulsions of an "oily" nonionic phase in the alkaline aqueous medium.

TABLE 4a gives the formulations used in a series of tests in which the effects of alkyl polyglucosides in caustic emulsions studied.

| Sample Names | | NaOH 50% | NPE 9.5 | APG 625 | PAA | F-80 | NTA | CBS-X | Acid Red #1 Dye | Pylaklor Cherry Dye | Keyfix Red Dye | Brilliant Orange Dye | $H_2O$ |
|---|---|---|---|---|---|---|---|---|---|---|---|---|---|
| HM1:0:N30 | NT4.2 | 58.5 | 30 | | 7.3 | | 4.2 | | | | | | |
| H4:1:N30 | A625-5 | 53 | 30 | 5 | 10 | 2 | | | | | | | |
| FV0:1:N30 | A625-5 | 51 | 30 | 5 | | 14 | | | | | | | |
| M6:7:N30 | A625-5 | 52 | 30 | 5 | 5 | 8 | | | | | | | |
| A4.5:10:N30 | A625-5 | 50.44 | 30 | 5 | 4.5 | 10 | | 0.05 | 0.008 | | | | |
| A4.9:N25 | A625-5 | 56.94 | 25 | 5 | 4 | 9 | | 0.05 | 0.012 | | | | |
| A4.5:10:N25 | A625-5 | 55.42 | 25 | 5 | 4.5 | 10 | | 0.05 | 0.03 | | | | |
| A5.4:12:N30 | A625-5 | 47.6 | 30 | 5 | 5.35 | 12 | | 0.05 | | 0.004 | | | |
| A5.4:12:N25 | A625-5 | 52.59 | 25 | 5 | 5.35 | 12 | | 0.05 | | | 0.012 | | |
| A4.5:10:N30 | | 55.44 | 30 | | 4.5 | 10 | | 0.05 | 0.008 | | | | |
| A4.5:10:N30 | A625-5 | 50.44 | 30 | 5 | 4.5 | 10 | | 0.05 | 0.008 | | | | |
| A4.5:10:N25 | | 60.42 | 25 | | 4.5 | 10 | | 0.05 | | | | 0.03 | |
| A4.5:10:N25 | A625-5 | 55.42 | 25 | 5 | 4.5 | 10 | | 0.05 | | | | 0.03 | |
| A4.5:10:N25 | H2O-5 | 55.42 | 25 | | 4.5 | 10 | | 0.05 | | | | 0.03 | 5 |
| A4.5:10:N30 | H2O-5 | 50.42 | 30 | | 4.5 | 10 | | 0.05 | | | | 0.03 | 5 |

| Formula Symbol | Raw Material | Description |
|---|---|---|
| NaOH 50% | Sodium Hydroxide | Aqueous 50% Caustic Soda |
| NPE 9.5 | Nonylphenol Ethoxylate 9.5 | 100% Non-ionic Surfactant |
| APG 625 | Glucopon 625 | Alkyl Polyglucoside (C12–C16) DP 1.60 |
| PAA | (Colloids 106 or Accusol 944) | Aqueous 50% Partially Neutralized Polyacrylic Acid |
| F-80 | Formula 80 | Aqueous 50% Poly(acrylic Acid-co-Itaconic Acid) |
| NTA | Nitrilo-Triacetic Acid, Trisodium Salt Monohydrate | Builder |
| CBS-X | Tinopal CBS-X | Optical Brightener |
| Acid Red #1 | Chromatech Acid Red #1 | Dye |
| Pylaklor Cherry | Pylam Pylaklor Cherry | Dye |
| Keyfix Red | Keystone Keyfix Red | Dye |
| Brilliant Orange | Liquitint Brilliant Orange | Dye |
| H2O | Water | Soft Water |

TABLE 4b gives another picture of the formulations tested, by comparing the poly(acrylic) acid (Colloids 106 or Accusol 944) and poly(acrylic acid/itaconic acid) copolymer (F-80) levels and ratios.

| Compound Name | | PAA | PAA to F-80 Ratio | Surfactant Level | APG 625 | Other Compounds |
|---|---|---|---|---|---|---|
| HM1:0:N30 | A625-5 NT4.2 | High Medium | 1:0 | 30% | 5% | NTA-4.2% |
| H4:1:N30 | A625-5 | High | 4:1 | 30% | 5% | |
| FV0:1:N30 | A625-5 | F-80 Very Ultra | 0:1 | 30% | 5% | |
| M6:7:N30 | A625-5 | Medium | 6:7 | 30% | 5% | |
| A4.5:10:N30 | A625-5 | Low | 4.5:10 | 30% | 5% | |
| A4:9:N25 | A625-5 | Low | 4:9 | 25% | 5% | |
| A4.5:10:N25 | A625-5 | Low | 4.5:10 | 25% | 5% | |
| A5.4:12:N30 | A625-5 | Low Medium | 5.4:12 | 30% | 5% | |
| A5.4:12:N25 | A625-5 | Low Medium | 5.4:12 | 25% | 5% | |
| A4.5:10:N30 | | Low | 4.5:10 | 30% | | |

TABLE 4b-continued gives another picture of the formulations tested, by comparing the poly(acrylic) acid (Colloids 106 or Accusol 944) and poly(acrylic acid/itaconic acid) copolymer (F-80) levels and ratios.

| Compound Name | PAA | PAA to F-80 Ratio | Surfactant Level | APG 625 | Other Compounds |
|---|---|---|---|---|---|
| A4.5:10:N30 A625-5 | Low | 4.5:10 | 30% | 5% | |
| A4.5:10:N25 | Low | 4.5:10 | 25% | | |
| A4.5:10:N25 A625-5 | Low | 4.5:10 | 25% | 5% | |
| A4.5:10:N25 $H_2O$-5 | Low | 4.5:10 | 25% | | Water-5% |
| A4.5:10:N30 $H_2O$-5 | Low | 4.5:10 | 30% | | Water-5% |

TABLE 4c gives the viscosity and centrifuge results for the aforementioned formulations. The use of APG stabilized the compositions.

| ID | Compound Name | | Viscosity 20 rpm | Viscosity 50 rpm | Ambient Stability | Particle Size (μm) | % separation @ Centrifuge Speeds Cen4 | Cen5 | Cen6 | Cen7 |
|---|---|---|---|---|---|---|---|---|---|---|
| 32 | HM1:0:N30 | A625-5 NT4.2 | 2105 | 1730 | ok | <0.625 | 0% | 0% | 0% | 0% |
| 40 | H4:1:N30 | A625-5 | 1830 | 1502 | ok | <0.625 | 0% | 0% | 0% | 0% |
| | FV0:1:N30 | A625-5 | 850 | 738 | ok | <0.625–5.0 | 0% | 0% | 0% | 0% |
| 48 | M6:7:N30 | A625-5 | 2230 | 1812 | ok | <0.625 | 0% | 0% | 0% | 0% |
| 62 | A4.5:10:N30 | A625-5 | 2040 | 1688 | ok | <0.625 | 0% | 0% | 0% | 0% |
| 63 | A4:9:N25 | A625-5 | 760 | 676 | ok | <0.625 | 0% | 0% | 0% | 0% |
| 64 | A4.5:10:N25 | A625-5 | 980 | 866 | ok | <0.625 | 0% | 0% | 0% | 0% |
| 65 | A5.4:12:N30 | A625-5 | 4370 | >2,000 | ok | <0.625–1.875 | 0% | 0% | <1% | <1% |
| 66 | A5.4:12:N25 | A625-5 | 1810 | 1432 | ok | <0.625–2.5 | 0% | 0% | <1% | <1% |
| 67 | A4.5:10:N:30 | | 3070 | >2,000 | ok | 2.5–26.875 | 8% | 11% | 18% | 26% |
| 68 | A4.5:10:N30 | A625-5 | 2005 | 1660 | ok | <0.625 | 0% | 0% | 4% | 4% |
| 69 | A4.5:10:N25 | | 3215 | 1974 | ok | 1.875–15 | <1% | 6% | 10% | 16% |
| 70 | A4.5:10:N25 | A625-5 | 1200 | 998 | ok | <0.625–2.5 | 0% | 0% | 0% | 10% |
| 72 | A4.5:10:N25 | $H_2O$-5 | 835 | 732 | ok | 4.375–38.125 | 8% | 16% | 28% | 42% |
| 73 | A4.5:10:N30 | $H_2O$-5 | 2425 | 1828 | ok | 3.125–41.25 | 12% | 22% | 30% | 36% |

These data show that alkyl polyglucoside reduced the viscosity of the formulas, reduced the particle size and stabilized the emulsion. The data also showed that other builders such as trisodium nitrilotriacetate monohydrate (NTA) in powdered form can be added to the formula in place of liquid builders such as poly(acrylic/itaconic) acid (F80). The data also indicated that the addition of other ingredients (optical brighteners, dyes and pigments) do not affect stability or other properties. These other ingredients are necessary for a desirable appearance and functioning of the detergent.

Figure 2:
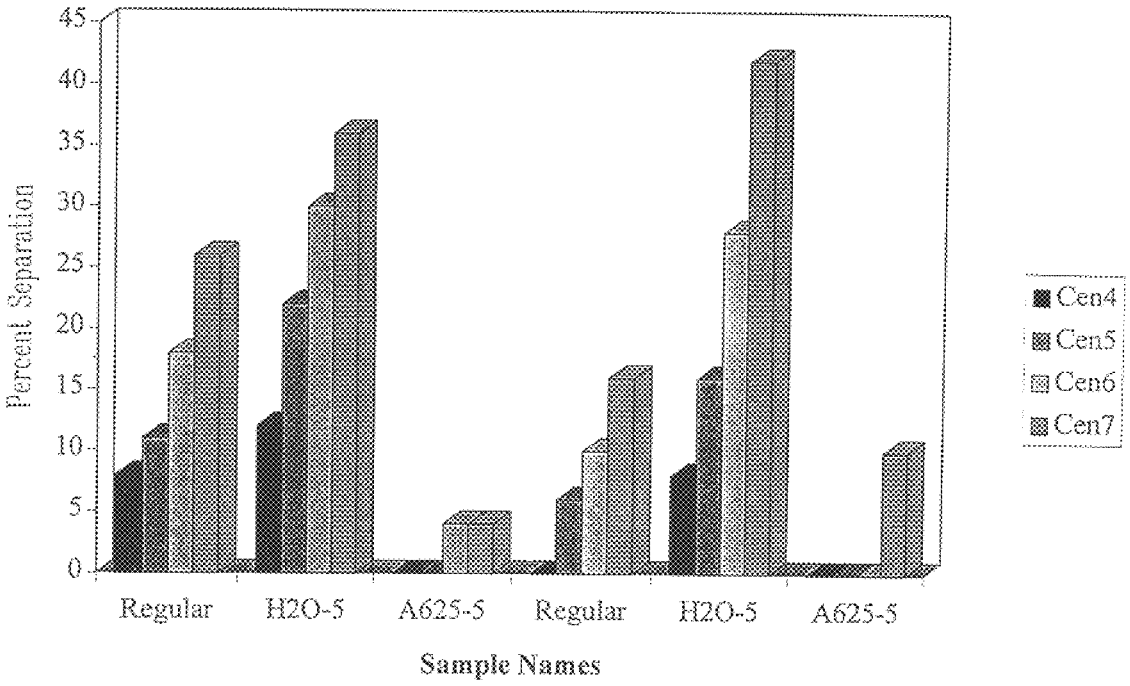
FIG. 2 is a 3D column graph which demonstrates the stabilizing effects of APG 625 on other caustic formulations.

The results clearly showed that stability (centrifuge test) is decreased when the alkyl polyglucoside removed from the formula is replaced with sodium hydroxide 50% (67 and 69) when compared with 68 and 70. This is seen graphically in FIG. 2. Viscosity is also higher for 67 and 69, when it is compared to formulations with alkylglucoside 68 and 70, respectively.

In some cases the viscosity of the formulation can be reduced with the addition of water in a portion of the total or replacing the alkyl polyglucoside. In formulation 67 the viscosity is reduced by the addition of water in place of the alkyl polyglucoside (70). Formulation 67 is not stable in the centrifuge test, whereas formulation 70 is stable.

The diameter of the particle size is also reduced with addition of alkyl polyglucoside. Formulations 67, 69, 72 and 73 did not contain any alkyl polyglucoside and the diameter of the particle size is between 2.5 and 41.3 microns. The addition of alkylglucoside (68 and 70) reduced the particle size between less than 0.625 to 2.5 microns. It is clearly demonstrated that stability is greatly improved with the addition of alkyl polyglucoside to the formulation. These corresponded to formulations 67, 68, 69, 70, 71 and 72. Without the alkylglucoside the formulations will separate in the centrifuge test.

Although an increase in viscosity (examples 67 and 69) might be thought to increase the stability of the emulsion, this is not always the case. Examples 68 and 70, which contain alkyl polyglucoside have a lower viscosity than examples 67 and 69, which don't contain alkyl polyglucoside. The former with lower viscosity are more stable than the latter. The formulations with alkyl polyglucosides are stable and have the desired viscosity.

TABLE 5a

| Sample Names | | NaOH 50% | NPE 9.5 | APG 625 | Bayhibit | PAA | CBS-X | Pigment | $H_2O$ |
|---|---|---|---|---|---|---|---|---|---|
| HA4:1:N30 | A625-5 | 54.9 | 30 | 5 | 2 | 8 | 0.05 | 0.004 | 0.05 |
| MA4:1:N30 | A625-5 | 57.6 | 30 | 5 | 1.25 | 6 | 0.05 | 0.004 | 0.05 |
| MA:4:1:N30 | A625-5 | 60.1 | 30 | 2.5 | 2 | 6 | 0.05 | 0.004 | 0.05 |
| HA:4:1:N30 | A625-5 | 57.4 | 30 | 2.5 | 2 | 8 | 0.05 | 0.004 | 0.05 |
| HA:4:1:N30 | A625-5 | 48.9 | 30 | 10 | 2 | 8 | 0.05 | 0.004 | 0.05 |
| HA:4:1:N30 | A625-5 | 49.6 | 30 | 0.3 | 2 | 8 | 0.05 | 0.004 | 0.05 |
| HA:4:1:N30 | A625-5 | 48.6 | 30 | 1.25 | 2 | 8 | 0.05 | 0.004 | 0.05 |

| Formula Symbol | Raw Material | Description |
|---|---|---|
| NaOH 50% | Sodium Hydroxide | Aqueous 50% Caustic Soda |
| NPE 9.5 | Nonylphenol Ethoxylate 9.5 | 100% Nonionic Surfactant |
| APG 625 | Glucopon 625 | Alkyl Polyglucoside ($C_{12-16}$) DP 1.60 |
| Bayhibit | Bayhibit AM | Aqueous 50% Phosphono Butane Tricarboxylic Acid |
| PAA | Colloids 106 or Accusol 944 | Aqueous 50% Partially Neutralized Polyacrylic Acid |
| CBS-X | Tinopal CBS-X | Optical Brightener |
| Pigment Blue | Pigment Blue 15 | Dye |
| H2O Added | Water | Soft Water |

The formulations in Table 5a readily formed emulsions. The materials were phase stable and were pumpable under typical dispenser use conditions using typical peristaltic pump dispensing equipment. The materials proved to be excellent laundry agents used at concentrations of about 100 to 500 ppm of detergent in service water.

The above specification, examples and data provide a complete description of the manufacture and use of the emulsion cleaners of the invention. Since many embodiments of the invention can be made without departing from the spirit and scope of the invention, the invention resides in the claims hereinafter appended.

We claim:

1. A liquid cleaner concentrate composition in the form of an aqueous emulsion having an aqueous phase and a dispersed phase, the composition comprising a phase stable emulsion comprising:

(a) a continuous aqueous phase;

(b) an effective soil removing amount comprising about 15 to about 50 wt % of a source of alkalinity;

(c) an effective soil removing amount comprising about 2 to about 60 wt % of a nonionic surfactant;

(d) an effective water conditioning or sequestering amount comprising about 0.1 to about 20 wt % of a water conditioning or sequestering agent; and (e) an effective soil removing and emulsion stabilizing amount comprising about 0.1 to 10 wt % of an alkyl polyglucoside surfactant;

wherein the dispersed phase comprises at least a portion of the nonionic surfactant and the emulsion concentrate has a viscosity permitting pumping during manufacture and use.

2. The composition of claim 1, wherein the viscosity comprises about 500 to 5000 cP at 23° C. using a #3 spindle with a RTV Brookfield viscometer at 20 rpm.

3. The composition of claim 1 wherein the viscosity comprises about 200 to 2000 cP at 23° C. using a #3 spindle with a RTV Brookfield viscometer at 50 rpm.

4. The composition of claim 1, wherein the dispersed phase comprises a particle of a size less than about 10 microns and the aqueous phase comprises less than about 60 wt % of the composition.

5. The composition of claim 1, wherein the dispersed phase comprises a particle of a size less than about 10 microns and the aqueous phase comprises less than about 40 wt % of the composition.

6. The composition of claim 1, wherein the dispersed phase comprises a particle of a size of about 0.01 to 5 microns and the aqueous phase comprises less than 35 wt % of the composition.

7. The composition of claim 1 wherein the nonionic surfactant comprises a $C_{6-18}$ alkyl-phenol alkoxylate having about 3 to 18 moles of alkylene oxide.

8. The composition of claim 1, wherein the nonionic surfactant comprises an alcohol alkoxylate having 5 to 15 moles of alkylene oxide in an alkoxylate group.

9. The composition of claim 1, wherein the nonionic surfactant comprises an EO block polymer comprising 3 to 24 moles of EO and a PO block polymer comprising 3 to 24 moles of PO.

10. The composition of claim 9, wherein the nonionic surfactant comprises an additional block of about 3 to 24 moles of an alkylene oxide.

11. The composition of claim 1 wherein the water conditioning agent comprises an organophosphonate sequestrant.

12. The composition of claim 1 wherein the water conditioning agent comprises a vinyl polymer having carboxyl functionality.

13. The composition of claim 1 wherein the alkyl polyglucoside comprises a surfactant having the formula:

$$RO(C_nH_{2n}O)_y(HEX)_x$$

wherein HEX is a hexose group; R is a hydrophobic typically lipophilic group selected from groups consisting of alkyl, alkylphenyl, hydroxyalkylphenyl and mixtures thereof in which said alkyl groups contain from about 8 to about 24 carbon atoms; n is 2 or 3; y is about 0 to 10 and x is about 1.5 to 8.

14. The composition of claim 13 wherein the hexose is glucose and the alkyl group has about 6 to about 24 carbon atoms.

15. The composition of claim 13 wherein y is 0 and x is about 1.5 to 4.

16. The composition of claim 1, wherein the emulsion is phase stable for at least 5 minutes under conditions of centrifugation in an International Equipment Centrifuge, Model CL at about 1100 to 2500 rpm.

17. A phase stable liquid emulsion laundry cleaner concentrate composition that has a stable viscosity, controlled particle size, the composition comprising:

(a) a continuous aqueous phase;

(b) about 15 to 50 wt % of sodium hydroxide;

(c) about 10 to 40 wt. % of a nonionic surfactant comprising at least an EO block polymer of 6 to 18 moles of ethylene oxide;

(d) about 0.1 to 20 wt. % of a blend of a polymeric water conditioning composition comprising a water soluble vinyl polymer having repeating pendent carboxyl groups and a water soluble organophosphonate composition; and (e) about 0.1 to 10 wt. % of an alkylpolyglycoside surfactant having the formula:

$$RO(C_nH_{2n}O)_y(HEX)_x$$

wherein HEX is a hexose group; R is a hydrophobic typically lipophilic group selected from groups consisting of alkyl, alkylphenyl, hydroxyalkylphenyl and mixtures thereof in which said alkyl groups contain from about 8 to about 24 carbon atoms; n is 2 or 3; y is about 0 to 10 and x is about 1.5 to 8;

wherein the dispersed phase comprises at least a portion of the surfactant and the particle size of the dispersed phase is about 0.01 to 10 microns, the viscosity of the composition is about 200 to 3000 cP at 23° C. using a #3 spindle in a RTV Brookfield viscometer at between 20 or 50 rpm;

and the emulsion composition is phase stable for at least 5 minutes at about 1100 to 2500 rpm in an International Equipment Centrifuge, Model CL.

18. The composition of claim 17, comprising about 20 to 40 wt. % of the nonionic surfactant.

19. The composition of claim 17, comprising about 5 to 20 wt % of the water conditioning composition.

20. The composition of claim 17, comprising about 5 to 10 wt % of the alkylpolyglycoside surfactant.

21. The composition of claim 17, wherein the nonionic surfactant comprises a alcohol alkoxylate having 5 to 15 moles of alkylene oxide in an alkoxylate group.

22. The composition of claim 17, wherein the nonionic surfactant comprises an EO block polymer comprising 3 to 24 moles of EO and a PO block polymer comprising 3 to 24 moles of PO.

23. The composition of claim 17, wherein the nonionic surfactant comprises an additional block of about 3 to 24 moles of an alkylene oxide.

24. A method of cleaning soiled laundry items comprising:

(i) contacting soiled laundry items with a wash liquor comprising a major proportion of water and about 250 to 5000 ppm of A liquid cleaner concentrate composition in the form of an aqueous emulsion having an aqueous phase and a dispersed phase, the emulsion having a stable viscosity and dispersed phase particle size, the composition comprising a phase stable emulsion comprising:

(a) a continuous aqueous phase;

(b) an effective soil removing amount comprising about 15 to about 50 wt % of a source of alkalinity;

(c) an effective soil removing amount comprising about 10 to about 60 wt % of a nonionic surfactant;

(d) an effective water conditioning or sequestering amount about 0.1 to about 20 wt % of a water conditioning or sequestering agent; and (e) an effective soil removing and emulsion stabilizing amount comprising about 0.1 to 10 wt % of an alkyl polyglucoside surfactant;

wherein the dispersed phase comprises at least a portion of the nonionic surfactant and the emulsion concentrate has a viscosity permitting pumping during manufacture and use to form a washed laundry; and (ii) rinsing the washed laundry with an aqueous rinse.

25. The method of claim 24 wherein the temperature of the wash liquor is about 25 to 80° C.

26. The method of claim 24 wherein the wash liquor comprises about 500 to 2000 ppm of the liquid cleaner.

27. A method of preparing a phase stable liquid emulsion cleaner composition, the method comprising:

(a) combining a nonionic surfactant, an alkyl polyglucoside composition and an aqueous base, the aqueous base comprising 50 wt. % active aqueous sodium hydroxide, to form an alkaline surfactant blend;

(b) combining the alkaline surfactant blend and a water conditioning agent to form an intermediate mixture; and (c) exposing the intermediate mixture to high shear to form a stable emulsion characterized by a viscosity of about 500 to 1500 cP at 23° C. using a #3 spindle with a RVT Brookfield viscometer at either 20 or 50 rpm, a particle size less than about 5 microns and an emulsion stability characterized by a stable emulsion for at least 5 minutes at 100 to 2500 in International Equipment Centrifuge, Model CL.

28. The method of claim 27 wherein the nonionic surfactant and the alkyl polyglucoside are blended prior to combining the aqueous base with the blended surfactant alkyl polyglucoside material.

29. The method of claim 27, wherein forming the intermediate mixture further comprises combining aqueous base with the combination of the alkaline surfactant blend and a water conditioning agent.

30. The method of claim 29, wherein forming the intermediate mixture further comprises combining aqueous base and one or more of polymeric material, additive, surfactant, alkylpolyglycoside, optical brightener, soil antiredeposition agent, antifoam agent, low foaming surfactant, defoaming surfactant, pigment, dye, chlorine bleach, or oxygen bleach to the combination of the alkaline surfactant blend and a water conditioning agent.

31. The composition of claim 1, wherein the source of alkalinity comprises an alkali metal hydroxide or an alkali metal silicate.

32. The composition of claim 31, wherein the alkali metal hydroxide comprises potassium hydroxide, sodium hydroxide, or a mixture thereof.

33. The composition of claim 32, wherein the alkali metal hydroxide comprises sodium hydroxide.

34. The composition of claim 7, wherein the nonionic surfactant comprises a $C_{6-18}$ alkyl-phenol ethoxylate having about 3 to 18 moles of ethylene oxide.

35. The composition of claim 34, wherein the nonionic surfactant comprises nonylphenol 9.5 mole ethoxylate.

36. The composition of claim 17, wherein the nonionic surfactant comprises a $C_{6-18}$ alkyl-phenol ethoxylate having about 3 to 18 moles of ethylene oxide.

37. The composition of claim 36, wherein the nonionic surfactant comprises nonylphenol 9.5 mole ethoxylate.

* * * * *